United States Patent [19]

Nierle

[11] Patent Number: 4,903,441

[45] Date of Patent: Feb. 27, 1990

[54] PREFABRICATED TRANSPORTABLE MODULAR RESIDENTIAL BUILDING

[76] Inventor: Pierre Nierle, 35 Avenue Eugéne-Lance, Grand-Lancy/Geneva, Switzerland

[21] Appl. No.: 76,140

[22] Filed: Jul. 21, 1987

[30] Foreign Application Priority Data

Aug. 28, 1986 [CH] Switzerland ..... 3459/86

[51] Int. Cl.[4] ..... E04H 1/12; E04B 1/19; E04C 2/26

[52] U.S. Cl. ..... 52/79.4; 52/79.7; 52/82; 52/125.2; 52/143; 52/309.7; 52/307.9; 52/DIG. 10

[58] Field of Search ..... 52/DIG. 10, 745, 309.7, 52/122.1, 80, 79.4, 82, 125.2, 143, 309.9, 79.7

[56] References Cited

U.S. PATENT DOCUMENTS

| | | | |
|---|---|---|---|
| 2,938,526 | 5/1960 | Harrison | 52/82 |
| 3,332,178 | 7/1967 | Foster | 52/82 |
| 3,502,091 | 3/1970 | Corbin | 52/DIG. 10 |
| 3,645,052 | 2/1972 | Hanna | 52/DIG. 10 |
| 3,660,952 | 5/1972 | Wilson | 52/81 |
| 3,749,594 | 7/1973 | Bibb | 52/309.7 |
| 3,974,600 | 8/1976 | Pearce | 52/81 |
| 4,133,149 | 1/1979 | Angress | 52/DIG. 10 |
| 4,189,892 | 2/1980 | Smith | 52/745 |
| 4,194,339 | 3/1980 | Fisher | 52/745 |
| 4,236,361 | 12/1980 | Boden | 52/309.7 |
| 4,271,645 | 6/1981 | Crooks | 52/DIG. 10 |
| 4,467,585 | 8/1984 | Busby | 52/122.1 |
| 4,542,759 | 9/1985 | Kyner | 52/81 |
| 4,663,898 | 5/1987 | Yacaboni | 52/80 |
| 4,723,382 | 2/1988 | Lalvani | 52/DIG. 10 |

FOREIGN PATENT DOCUMENTS

| | | | |
|---|---|---|---|
| AD79350 | 10/1962 | France | 52/79.4 |
| 1381851 | 11/1964 | France | 52/82 |
| 2559180 | 8/1985 | France . | |
| 663912 | 12/1951 | United Kingdom | 52/82 |

*Primary Examiner*—John E. Murtagh
*Attorney, Agent, or Firm*—Kane, Dalsimer, Sullivan, Kurucz, Levy, Eisele and Richard

[57] ABSTRACT

The residential building is composed of an indeformable triangulated framework provided with a covering defining a volume having a triangular, square or hexagonal base and three or four faces whose pitch is greater than 45 degrees and facades or connecting planes between modules, resulting from the division of a pyramid by vertical planes. The apex is provided with a hook intended for the transport of the modules by helicopter.

9 Claims, 6 Drawing Sheets

Fig. 1
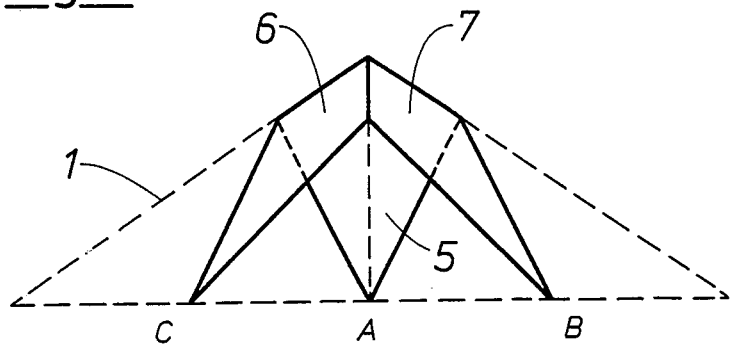
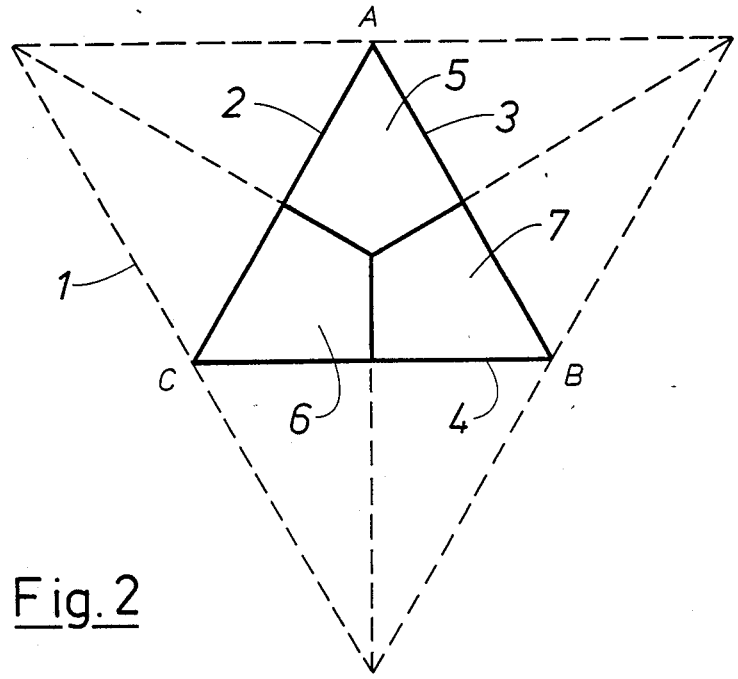
Fig. 2

Fig. 3
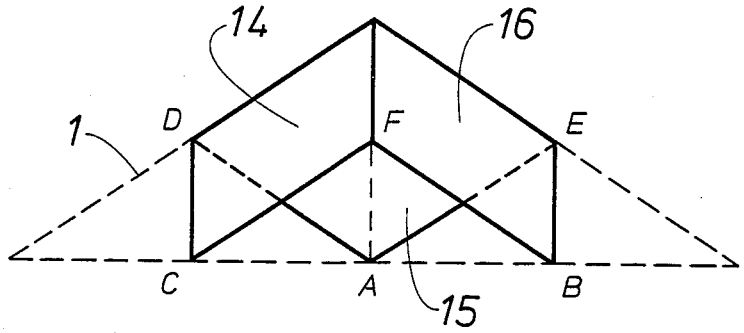
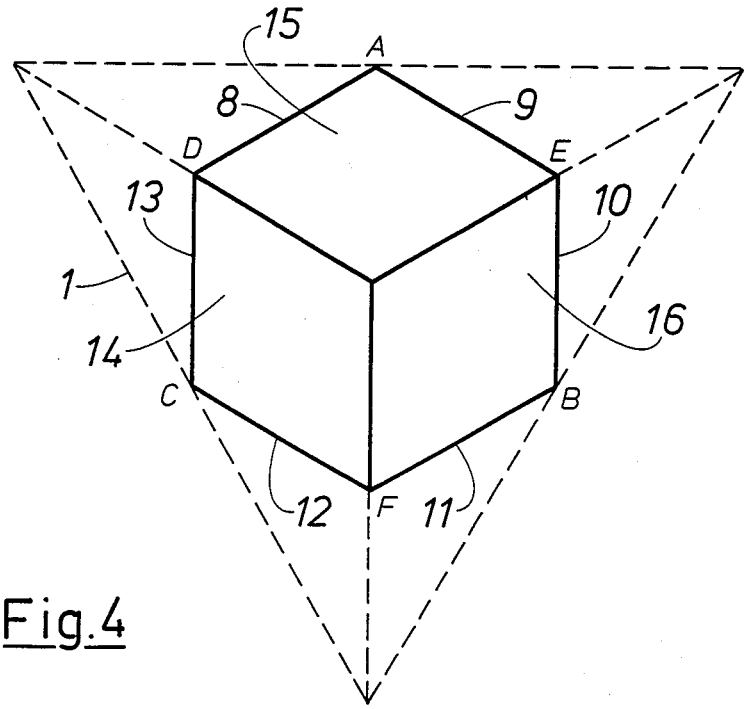
Fig. 4

Fig.5
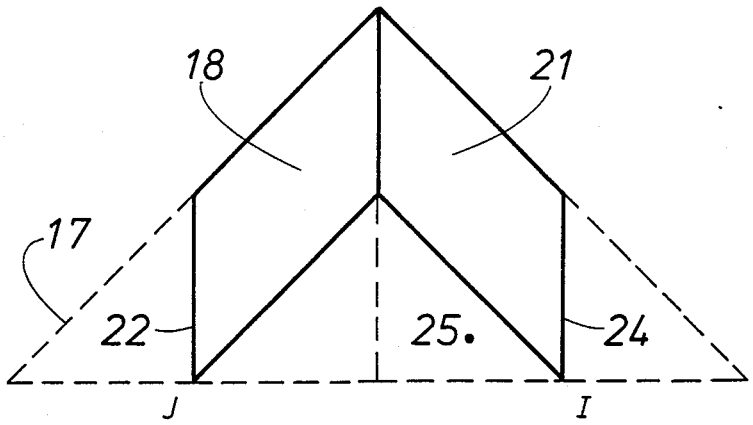
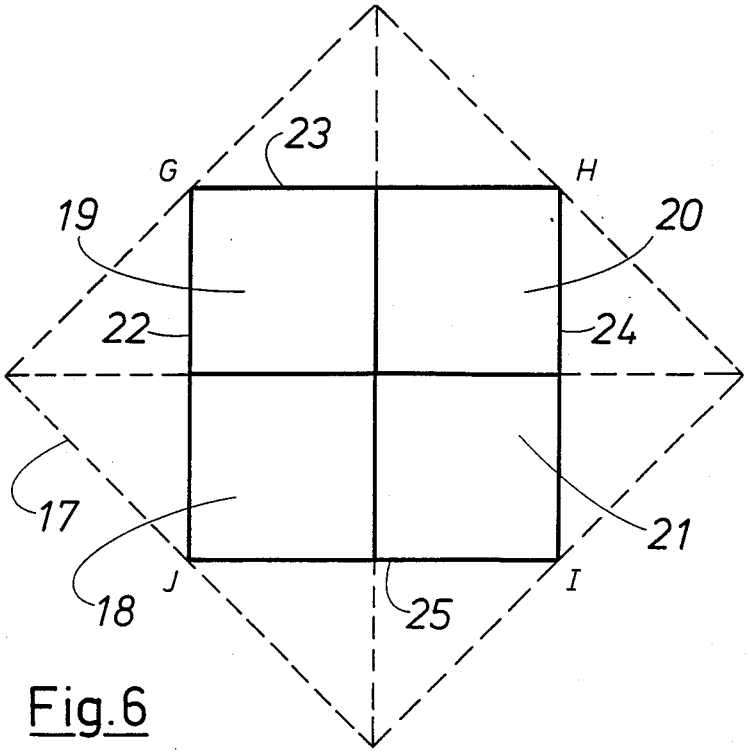
Fig.6

PREFABRICATED TRANSPORTABLE MODULAR RESIDENTIAL BUILDING

FIELD OF THE INVENTION

The present invention relates to a prefabricated transportable modular residential building comprising at least one module adapted to be joined to at least one other module in order to form a whole.

PRIOR ART

Transportable residential buildings in use at the present time are either buildings mounted on wheels and adapted to be towed by a vehicle, or cells without wheels which can be transported on the platform of a truck. These buildings are rectangular in shape, and their width and height are limited by the requirements of road transport. They are therefore necessarily relatively narrow and their internal arrangement must be adapted to very restrictive conditions. With regard to towed buildings of the 'module home' type, these are in addition not adapted to be juxtaposed so as to form a larger whole.

SUMMARY OF THE INVENTION

The present invention seeks to provide a prefabricated transportable modular residential building which is not subject to the dimensional constraints entailed by road transport, that is to say a residential buliding adapted to be transported by air, and more precisely by helicopter. To this end, the residential building module must also be as light as possible and indeformable. It must in addition have vertically a streamlined shape such that the flow of air displaced by the helicopter will pass easily over the module without producing any reaction preventing the helicopter from rising. The module must in addition have a shape permitting juxtaposition to other modules, which means that its base may be only triangular, square, or hexagonal. Its shape must must in addition be easily integrated into the landscape.

This aim is achieved with the prefabricated residential building of the kind defined in claim 1. The framework is for example of metal, preferably of light alloy, while the bars of the triangulated system may be tubular or sectional. The framework could however also be of synthetic material or of mineral fibers, such as glass or carbon fibers.

The pitch of the faces constituting the roof, which is greater than 45 degrees, not only permits transport of the residential building modules by helicopter, but also ensures that snow will readily slide off.

BRIEF DESCRIPTION OF THE DRAWINGS

The accompanying drawings illustrate by way of example some embodiments of the invention.

FIG. 1 is a schematic view in elevation of a module having a triangular base.

FIG. 2 is a schematic plan view of a module having a triangular base.

FIG. 3 is a schematic view in elevation of a module having a hexagonal base.

FIG. 4 is a schematic plan view of a module having a hexagonal base.

FIG. 5 is a schematic view in elevation of a module having a square base.

FIG. 6 is a schematic plan view of a module having a square base.

DESCRIPTION OF THE PREFERRED EMBODIMENTS

Figure 7:
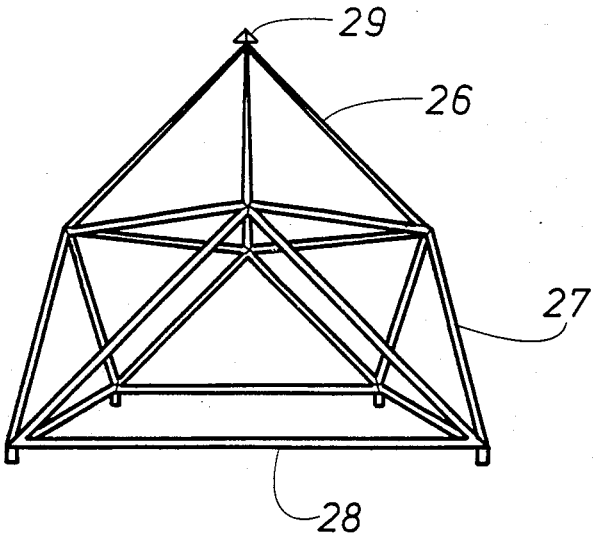
FIG. 7 is a view in perspective of the framework of a module having a square base.

The module shown in FIGS. 1 and 2 is obtained from a triangular pyramid 1 whose base is composed of an equilateral triangle and whose faces have been intersected by three vertical planes 2, 3 and 4 passing through the centers A, B and C of the sides of the base triangule. A module having a triangular base is thus obtained which has three lozenge-shaped faces 5, 6 and 7, leaving three sides corresponding to the vertical planes 2, 3 and 4, these sides constituting vertical walls in which windows and doors are formed, and which in addition enable a module to be placed side by side with another module, while the juxtaposed sides may remain open. It is immediate possible to start with a triangular pyramid having an angle at the apex such that the slope of the faces 5, 6 and 7 is greater than 45 degrees. This slope may without difficulty be as great as 60 degrees.

The module according to FIGS. 3 and 4 is obtained from the same triangular pyramid as the first module. It differs from the latter in that the pyramid is intersected, not by three vertical planes, but by six vertical planes 8, 9, 10, 11, 12 and 13, each passing through one of the centers of the sides of the base A, B and C and through the centers D, E and F of an edge. These six vertical planes define a hexagonal base and three oblique roof faces 14, 15 and 16, which once again are lozenze-shaped, and of which one apex coincides with one of the apices A, B and C of the base of the module. The vertical dividing planes define six vertical sides, which are provided with walls or which permit the juxtaposition of the module against another hexagonal module. The ground area and the inhabitable volume of the hexagonal cell are naturally substantially larger than those of the triangular cell.

FIGS. 5 and 6 show schematically a residential building module having a square base. This module is obtained from a pyramid 17 which has a square base and whose edges are inclined at about 45 degrees. The volume of the module is obtained by dividing this pyramid by four vertical planes passing through the centers G, H, I and J of the sides of the base. Four roof faces having the shape of equilateral lozenges 18, 19, 20 and 21 are thus obtained, whose pitch is greater than 45 degrees. This module having four faces also has four vertical triangular facades 22, 23, 24 and 25, which are closed by panels provided with doors and windows or left open for the juxtaposition of the module against another similar module.

FIG. 7 shows by way of example the triangulated framework of a square-based module according to FIGS. 5 and 6. This entirely triangulated framework is composed of metal bars, such as 26, 27 and 28. The bars are either tubular or sectional. The nodal points are welded or bolted on connectors. The nodal points could also be in the form of solid members in which the ends of the bars are embedded and screwed or welded. The apex of the framework is provided with a suspension hook for transport of the module by helicopter.

Figure 8:
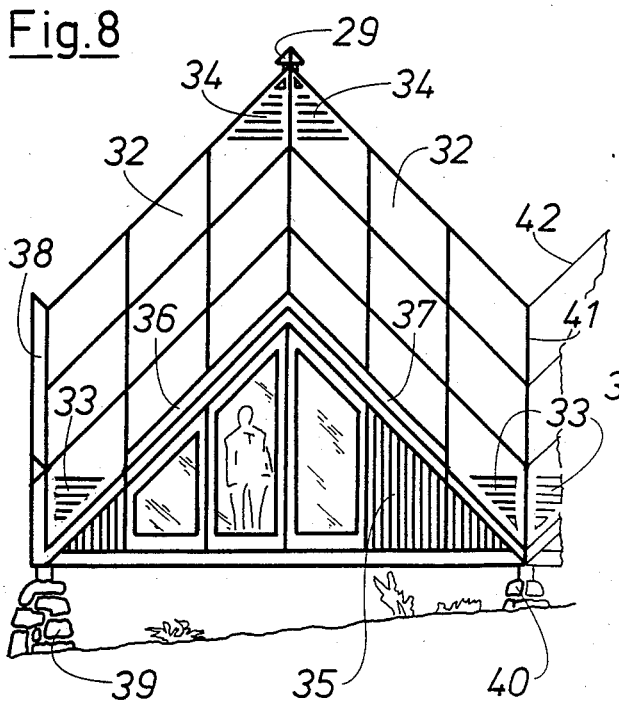
FIG. 8 is a view in elevation of a completed, installed module having a square base.
Figure 9:
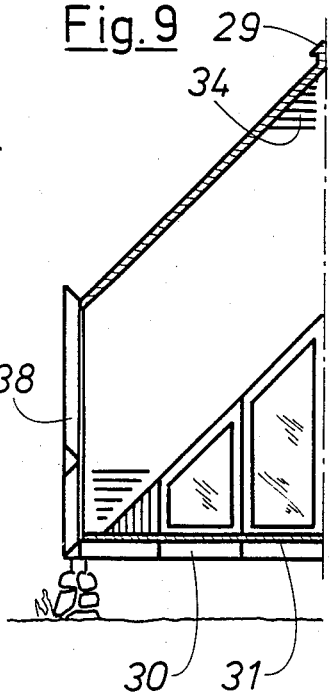
FIG. 9 is a vertical axial half-section of the module shown in FIG. 8.

FIGS. 8 and 9 show a completed residential building module. The floor is composed of a secondary structure 30 carried by the framework bars. On this secondary structure 30 is laid the thermal insulation and floor covering 31. The roof faces are composed of a light structure combined with the thermal insulation, and the whole arrangement is covered by a covering composed of sheets 32 or by a casing of synthetic material. Natural ventilation is provided by adjustable opening. 33 and 34 formed at the bottom and top of each roof face respectively. In summer they enable heat to be discharged by a chimney effect. The facades are closed by walls 35 consisting of standardized glazed or solid members. These walls are fitted on the modules at the factory. They are protected by framings of synthetic material, such as 36, 37 and 38 fixed directly on the module, their gutter-like shape conducting rain and snow. The high pitch ensures good flow-off. The interior arrangement corresponds to the dimensions of the building and comprises standardized elements. At high altitudes and in northern countries the residential building module will preferably be mounted on pillars 39 and 40, so that the snow can slide off the roof in the winter. THe junction 41 to another module 42 is made by means of a flexible joint of plastic material, constructed on site.

Figure 10:
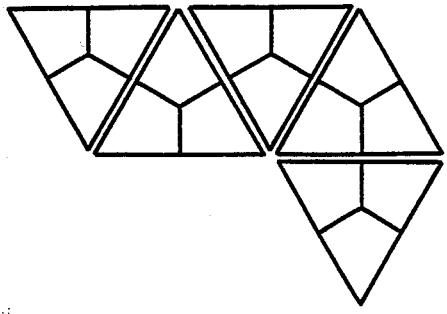
FIG. 10 shows schematically in plan an example of the combination of modules having triangular bases.

Whether the base of the modules is triangular, square or hexagonal, they can be juxtaposed in various ways and in unlimited numbers in order to obtain the desired living area. FIG. 10 shows an example of a residential building constructed with the aid of five triangular modules, four modules being disposed in such a manner as to form a parallelogram.

Figure 11:
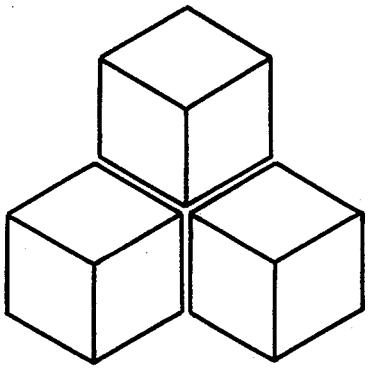
FIG. 11 shows schematically in plan an example of the combination of modules having hexagonal bases.

FIG. 11 shows an example of a building produced with the aid of three hexagonal modules.

Figure 12:
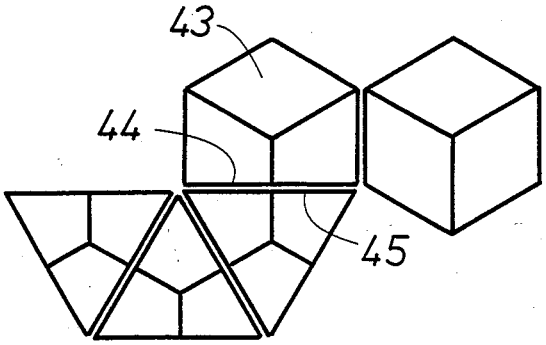
FIG. 12 shows schematically in plan an example of the mixed combination of modules having triangular and hexagonal bases with a transition module.

FIG. 12 shows an example of a building produced with the aid of three triangular modules and one hexagonal module connected by a transition module 43 formed from a hexagonal module intersected by a vertical plane passing through two of the apices of the base which are not diametrically opposite, that is to say through the centers of two sides of the basic triangular pyramid. If the triangular and hexagonal modules are based on the same triangular pyramid, the openings 44 and 45 will be identical and juxtaposable.

Figure 13:
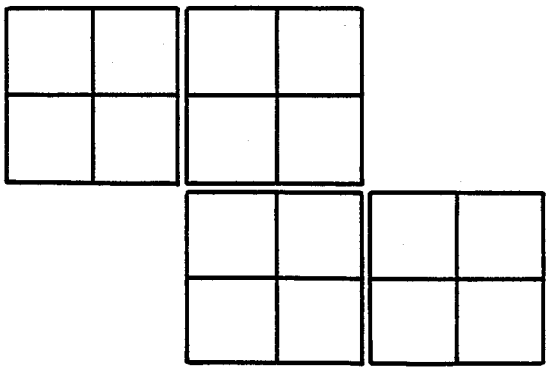
FIG. 13 shows an example of the combination of modules having square bases.

FIG. 13 shows schematically an example of a residential building produced with the aid of square modules having a square base.

Figure 15:
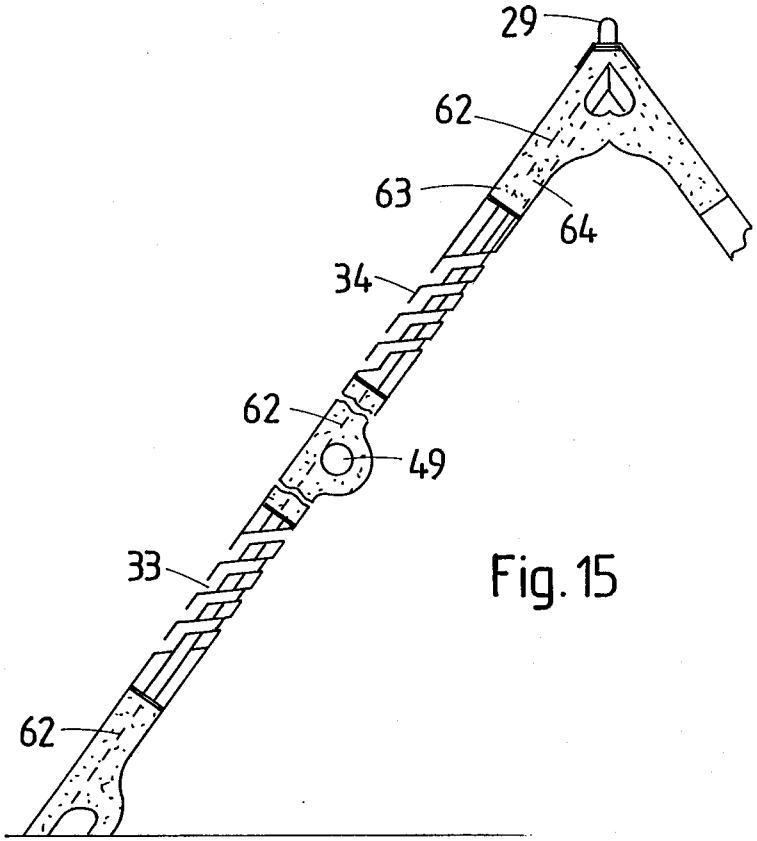
FIG. 15 is a view in diagonal section of a face of a module according to FIG. 8.
Figure 14:
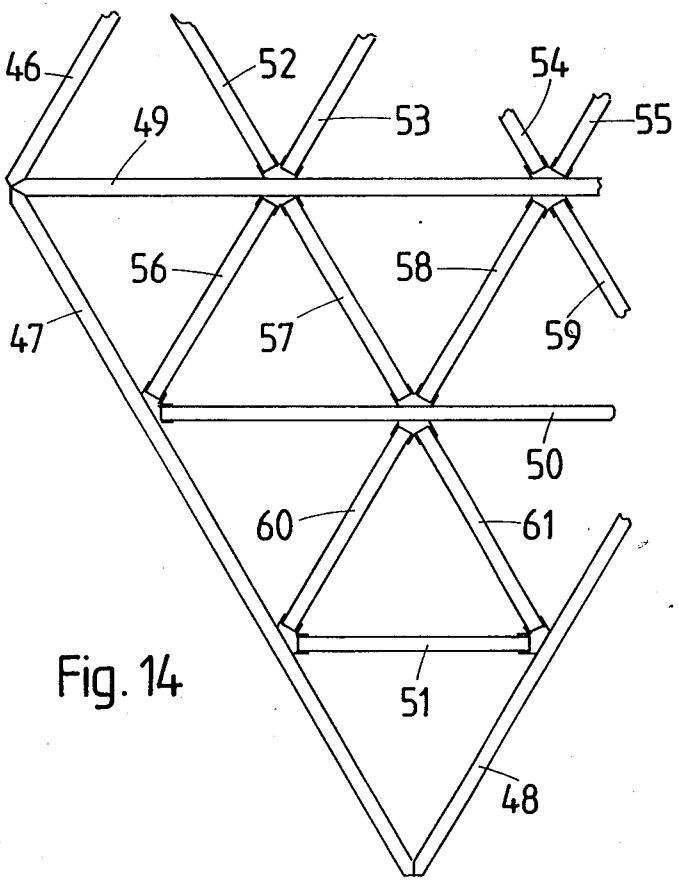
FIG. 14 shows schematically the tubular framework of a face of a module according to FIG. 8.

An example of light construction of the faces of the module according to FIGS. 8 and 9 is shown schematically in FIGS. 14 and 15. The structure comprises a triangulated tubular framework shown schematically in FIG. 14. In the example under consideration the framework is composed of steel tubing of a diameter of 80 mm. The tubes, such as 46, 47 and 48 delimiting the lozenge have a length of 4.14 meters and a wall thickness of 4 millimeters. The framework also includes a horizontal diagonal tube 49 of a wall thickness of 4 millimeters, parallel to which two tubes 50 having a wall thickness of 2 millimeters and two tubes 51 having a wall thickness of 1 millimeter are disposed. The tubes listed above are cross-braced by tubes having a wall thickness of 1 millimeter, such as the tubes 52 to 61.

On these tubes is welded a fine metal trelliswork 62, the mesh of which corresponds to that of mosquito netting. On each side of this trelliswork a layer of polyurethane foam 63 and 64 is then sprayed to a thickness of 50 millimeters, by a method known per se. The foam preferably also covers the tubes of the tubular framework, as can be seen in the drawing in the case of the tube 49. A panel of reinforced polyurethane foam of perfectly adequate strength is thus obtained. In tests these panels withstood a load of 5,000 $N/m^2$.

What I claim is:

1. A prefabricated transportable residential building, comprising at least one module adapted to be joined to at least one other module to form a whole, wherein each module is composed of an indeformable, and light triangulated framework, said triangulated framework having an apex at its highest point, whose envelope defines a geometrical volume having a geometrically shaped base and three oblique faces whose slope is greater than 45 degrees, this volume resulting from the division of the faces of a pyramid by vertical planar portions passing through the centers of the sides of the base of the pyramid, the geometrically shaped base being in the plane of the pyramid base, and is further composed of a floor in the plane of the base of the pyramid, each of the three faces being in the plane of a face of the pyramid and extending from the apex to one of the centers of the sides of the base of the pyramid, a leakproof covering of the oblique faces, the vertical portions not contiguous to another module, said vertical portions being provided with walls adapted to be equipped with doors and windows, and open vertical portions serving for the juxtaposition of modules one against the other, the apex of the framework being provided with a suspension means adapted for transport of the module by helicopter.

wherein the oblique faces are composed of a triangulated tubular frame work supporting a panel of polyurethane foam reinforced with plastic trelliswork welded to the frame.

2. A residential building as claimed in claim 1, which comprises at least one transition module allowing the juxtaposition of a module having a triangular base with a module having a hexagonal base produced from the same triangular pyramid, said transition module being formed from a hexagonal module intersected by a vertical plane passing through two non-opposite apices. of its base, that is to say through the centers of two sides of the base of the basic pyramid.

3. A building according to claim 1 wherein the triangulated framework is composed of light weight metal bars.

4. A building according to claim 3 wherein the triangulated framework comprises tubular bars.

5. A building according to claim 4 wherein the bars have a wall thickness substantially equal to 4 millimeters.

6. A building according to claim 1 wherein the roof oblique faces touch the base.

7. A prefabricated transportable module residential building comprising at least one module adapted to be joined to at least one other module to form a whole, wherein each module is composed of an indeformable triangulated framework having an apex at its highest point whose envelope defines a geometrical volume having a triangular base and three oblique faces whose slope is greater than 45 degrees, this volume resulting from the division of the faces of a pyramid having a triangular base in the plane of the triangular base of the envelope by vertical planar portions passing through the centers of the sides of the base and is further composed of a floor in the plane of the triangular base of the pyramid, each of the three faces being in the plane of a face of the pyramid and extending from the apex to one of the centers of the sides of the triangular base of the pyramid, a leakproof covering of the oblique faces, the vertical portions not contiguous to another module, said vertical portions being provided with walls adapted to be equipped with doors and windows, the open divided portions serving for the juxtaposition of modules one against the other, the apex of the framework being provided with a suspension means adapted for transport of the module by helicopter wherein the oblique faces are composed of a triangulated tubular frame work supporting a panel of polyurethane foam reinforced with plastic trelliswork welded to the frame.

8. A prefabricated transportable modular residential building, comprising at least one module adapted to be joined to at least one other module to form a whole, wherein each module is composed of an indeformable, and light triangulated framework, said triangulated framework having an apex at its highest point, whose envelope defines a geometrical volume having a square base and four oblique faces whose slope is greater than 45 degrees, this volume resulting from the division of the faces of a pyramid having a square base in the plane of the square base of the envelope by vertical planar portions passing through the center of the sides of the base and is further composed of a floor in the plane of the square base of the pyramid, each of the four faces being in the plane of a face of the pyramid and extending from the apex to one of the centers of the sides of the square base of the pyramid, a leakproof covering of the oblique faces, the vertical portions not contiguous to another module, said vertical portions being provided with walls adapted to be equipped with doors and windows, the open divided portions serving for the juxtaposition of modules one against the other the apex of the framework being provided with a suspension means adapted for transport of the module by helicopter wherein the oblique faces are composed of a triangulated tubular frame work supporting a panel of polyurethane foam reinforced with plastic trelliswork welded to the frame.

9. A prefabricated transportable modular residential building comprising at least one module adapted to be joined to at least one other module to form a whole, wherein each module is composed of an indeformable, and light triangulated framework having an apex at its highest point whose envelope defines a geometrical volume having a hexagonal base and three oblique faces whose slope is greater than 45 degrees, this volume resulting from the division of the faces of a pyramid having a triangular base in the plane of the hexagonal base by vertical planar portions passing through the centers of the sides of the triangular base and is further composed of a floor in the plane of the triangular base, each of the three faces being in the plane of a face of the pyramid and extending from the apex to one of the centers of the sides of the triangular base of the pyramid, a leakproof covering of the oblique faces, the vertical portions not contiguous to another module, said vertical portions being provided with walls adapted to be equipped with doors and windows, the open divided portions serving for the juxtaposition of modules one against the other, the apex of the framework being provided with a suspension means adapted for transport of the module by helicopter wherein the oblique faces are composed of a triangulated tubular frame work supporting a panel of polyurethane foam reinforced with plastic trelliswork welded to the frame.

* * * * *